United States Patent [19]

Ohashi et al.

[11] 4,265,679

[45] May 5, 1981

[54] PROCESS FOR PRODUCING STAINLESS STEELS FOR SPRING HAVING A HIGH STRENGTH AND AN EXCELLENT FATIGUE RESISTANCE

[75] Inventors: Nobuo Ohashi, Funabashi; Yutaka Ono, Ichihara; Kiyohiko Nohara, Chiba; Junichi Shimomura, Chiba; Tetsuo Miyawaki, Chiba, all of Japan

[73] Assignees: Kawasaki Steel Corporation, Kobe; Nippon Kinzoku Co., Ltd., Tokyo, both of Japan

[21] Appl. No.: 69,050

[22] Filed: Aug. 23, 1979

[51] Int. Cl.[3] ..... C21D 7/02

[52] U.S. Cl. ..... 148/12 E; 148/38; 148/125

[58] Field of Search ..... 148/12 E, 125, 136, 148/38

[56] References Cited

U.S. PATENT DOCUMENTS

| | | | |
|---|---|---|---|
| 3,871,925 | 3/1975 | Nunes | 148/12 E |
| 3,917,492 | 11/1975 | Backman et al. | 148/12 E |
| 4,042,421 | 8/1977 | Van Den Sype et al. | 148/12 E |

*Primary Examiner*—Peter K. Skiff

*Attorney, Agent, or Firm*—Balogh, Osann, Kramer, Dvorak, Genova & Traub

[57] ABSTRACT

Stainless steels for springs having a high strength and an excellent fatigue resistance are produced by heat treating austenitic stainless steels having such a composition that austenite stability index, $Md_{30}$. is 0° C. to +80° C. at a final annealing temperature of 750°-1,150° C., subjecting the thus treated steels to a primary working at a temperature from $Md_{30}$ to 500° C. at a reduction rate of not less than 20% and then subjecting said steels to a secondary working at a temperature lower than $Md_{30}$ at a reduction rate of not less than 30%.

2 Claims, 6 Drawing Figures

Figure 1:
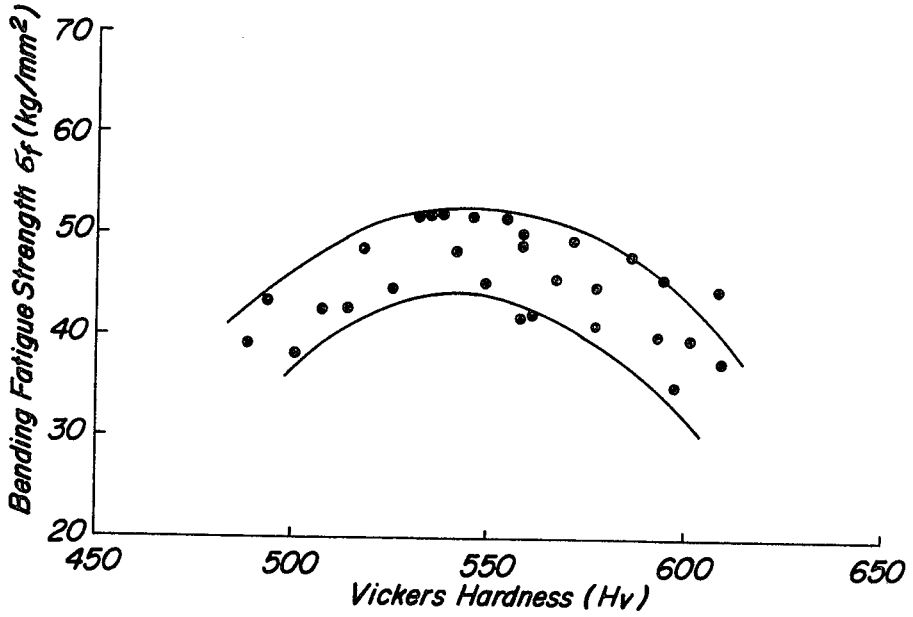

PROCESS FOR PRODUCING STAINLESS STEELS FOR SPRING HAVING A HIGH STRENGTH AND AN EXCELLENT FATIGUE RESISTANCE

The present invention relates to a process for producing stainless steels for spring having a high strength and an excellent fatigue resistance. Beryllium, copper alloys, nickel silver and the like have been heretofore used as spring materials for various switches and relays of communication instruments, measuring instruments and electrical instruments, building parts and other electronic parts. However, thin flat or wire springs made of stainless steels having higher strength, threshold value of spring, excellent bending workability, and high corrosion resistance have been recently broadly used instead of the above described various materials. Furthermore, the application of stainless steels has been more increased as spring materials, such as external parts of various vehicles, for example springs for brake shoe, wheel cover, spiral springs for a retractor in a seat belt of passanger car and the like.

As stainless steels for such springs, mention may be made of metastable austenitic stainless steels represented by SUS 301 (based on JIS (Japanese Industrial Standard) corresponding to AISI 301, and so forth in the present invention), and precipitation hardening type austenitic stainless steels represented by 17-7 PH steel. The prior treatments applied to these stainless steels for these springs are substantially same and the hot worked sheet is subjected to the solution heat treatment and then cold worked at room temperature into the given thickness (in the case of flat springs) or wire diameter (in the case of wire springs) to obtain the desired hardness and then to the forming to obtain springs. Thereafter, in many cases, concerning the flat springs (SUS 301), said springs are subjected to tempering treatment at a temperature of about 200°-550° C., while concerning the wire springs 17-7 PH, said springs are subjected to precipitation hardening at a temperature of about 400°-600° C.

As mentioned above, the thus treated stainless steel spring materials have generally excellent properties but the demand for improvement of the properties of the spring materials has recently become severe and the stainless steels for springs having both higher strength (higher hardness) and more excellent fatigue resistance have been demanded. The spiral springs for retractor in safety belts of automobiles are the typical ones.

It has been well known that when the mestastable austenite stainless steels represented by SUS 301 are cold rolled, the high strength is obtained and this is because austenite is transformed into martensite due to the working. Furthermore, it has been publicly known that the hardness is more or less increased by the strain aging owing to the subsequent tempering treatment. In this regard, the volume percent of martensite formed is influenced by the chemical composition, the quantity of working and working temperature, but in the ordinary production process, the austenitic stainless steel is usually worked at room temperature, so that the amount of martensite is principally determined by the quantity of working.

FIG. 1 shows the results when the Vickers hardness (Hv) and the bending fatigue strength ($\sigma_f$) were measured after SUS 301 (C: 0.1%, Si: 0.69%, Mn: 0.89%, P: 0.026%, S: 0.004%, Ni: 6.98%, Cr: 17.39%, Mo: 0.11%) was treated following to the above described usual production process, that is, the hot rolled sheet was subjected to the solution treatment and then rolled by varying the reduction rate in a range of 40-90% at a temperature of 20°-30° C. to produce a 0.45 mm thick spring material and the thus treated sheet was tempered at 400° C. for 1 hour.

This fatigue test was carried out by an alternating plane bending fatigue testing machine at a frequency of 1,000 cycle/min and the breakage strength corresponding to the repeating bending of $3\times10^6$ times is referred to as $\sigma_f$(kg/mm$^2$).

This $\sigma_f$ value itself, even if the test material is the same, if the test method varies, may vary, so that the said value proves to be just relative in the test mentioned herein.

The result shows the tendency that as the hardness becomes higher, the fatigue strength becomes higher similar to the prior knowledge, but if the hardness exceeds a certain value as in Hv$>$540, the tendency that the fatigue strength reversely lowers, appears.

FIG. 1 shows the results when the working has been carried out at near room temperature and that as far as the production is carried out by the above described usual process, when Hv is larger than about 540, the fatigue strength greatly lowers and the obtained maximum $\sigma_f$ is less than 55 kg/mm$^2$.

When mention is made with respect to spiral springs for retractor in safety seat belt of automobiles as a typical practical example of these springs, the springs presently produced aim at Hv of about 520 and therefore, $\sigma_f$ according to the above described test is only about 50 kg/mm$^2$.

On the other hand, for such an application, it is more strongly required that in order to secure the high tension of the safety belt, the torque of the springs is more enlarged and this torque is not deteriorated during use and further the long fatigue durability is obtained, and the materials wherein Hv is about 550-600, which is apt to cause the fear of fatigue breakage in the conventional springs and further the fatigue strength is much higher (for example more than 60 kg/mm$^2$), have been demanded.

However, this is a contradictory demand against the prior performance shown in FIG. 1 and can not be substantially accomplished by the usual production process.

A purpose of the present invention is to accomplish such a difficult aim by the particularly advantageous means.

The inventors have noticed that the problem can not be solved only by subjecting austenitic stainless steel to the solution treatment and then working the thus treated steel at room temperature, and have made various investigations from the completely different view points from the prior ones and succeeded in accomplishment of the object by the novel idea that the working temperature is classified into two stages, the temperature range of each stage is properly set depending upon the austenite stability index of the steel (easiness of formation of martensite due to the plastic deformation) and the quantity of working at each stage is properly established.

The present invention consists in a process for producing stainless steels for springs with a high strength and an excellent fatigue resistance, which comprises heat treating austenitic stainless steels having such a composition that the austenite stability index, $Md_{30}$, is a range of 0° C. to +80° C., at a temperature of 750°—1,150° C., subjecting said steels to a primary working which conducts the rolling reduction at a rate of not less than 20% within a temperature range from $Md_{30}$ to 500° C. and then subjecting the thus treated steels to a secondary working which conducts the rolling reduction at a rate of not less than 30% at a temperature lower than $Md_{30}$.

The austenite stability index, $Md_{30}$, of the above described austenitic stainless steel conforming to the present invention is shown by the following formula.

$$Md_{30}=551-462(C\%+N\%)-9.2Si\%-8.1Mn\%-29(Ni\%+Cu\%)-13.7Cr\%-18Mo\%+0\times Al\%-68(Nb\%+Ti\%+Ta\%)-1.4(\text{ASTM austenite grain size number}-8.0)$$ (%: weight %).

$Md_{30}$ indicates the characteristic temperature (°C.) at which 50% of the structure is transformed into martensite intension after a true strain of 0.30 and the higher $Md_{30}$ value shows that the formation of martensite upon working is the easier and the material is the more unstable.

The composition range of the steels to be applied to the present invention is as follows.

The fundamental components consist of not more than 0.15% of carbon, 0.3–2.0% of silicon, 0.5–2.0% of manganese, 6.0–14.0% of nickel, and 13.0–20.0% of chromium and if necessary, at least one of not more than 1.5% of aluminum, not more than 2.0% of molybdenum and not more than 3.0% of copper is contained, and the remainder is iron and the general incidental impurities.

In the present invention, the same result can be obtained by conducting a tempering treatment at a temperature lower than As point which is not lower than 200° C. and where martensite is reversely transformed into austenite, after the above described secondary working.

In carrying out the present invention, even when the primary working is performed in several passes, the working temperature may be a particularly defined constant temperature between $Md_{30}$ and 500° C. or different temperature at every pass also between $Md_{30}$ and 500° C.

An exaplanation will be made with respect to the functional effect brought about by the process of the present invention.

Figure 2:
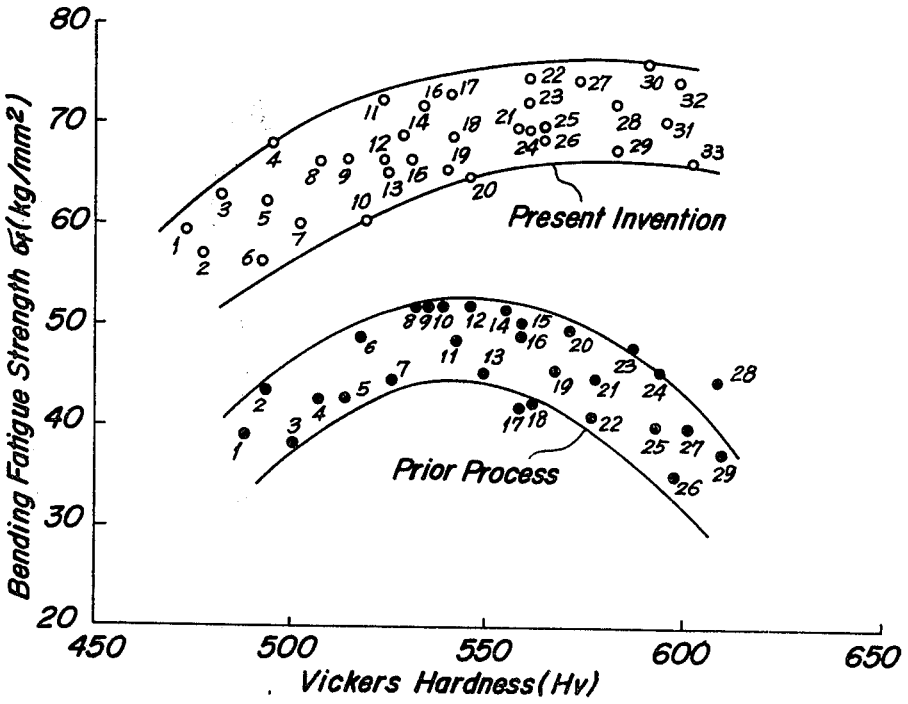

FIG. 2 shows the relation of the hardness to the fatigue strength of thin flat spring materials having a thickness of 0.45 mm, which have been produced by treating SUS 301 material under the conditions defined in the present invention and then tempering the thus treated steels at 400° C. for 1 hour. For comparison, the results in FIG. 1 obtained by the conventional process using the same material as described above are shown together. These rolling conditions are shown in the following Table 1.

TABLE 1(a)

| Prior process | | | Present invention | | | | | |
|---|---|---|---|---|---|---|---|---|
| | | | | Primary rolling | | Secondary rolling | | Total |
| Sample No. | Rolling temperature (°C.) | Reduction rate (%) | Sample No. | Temperature (°C.) | Reduction rate (%) | Temperature (°C.) | Reduction rate (%) | reduction rate (%) |
| 1 | 25 | 40 | 1 | 200 | 25 | 30 | 33 | 50 |
| 2 | " | " | 2 | " | " | " | " | " |
| 3 | " | " | 3 | 150 | " | " | " | " |
| 4 | 20 | " | 4 | 100 | " | " | " | " |
| 5 | 25 | " | 5 | " | " | 25 | " | " |
| 6 | 20 | 50 | 6 | " | " | " | " | " |
| 7 | " | " | 7 | " | " | " | " | " |
| 8 | " | 60 | 8 | 80 | " | 20 | " | " |
| 9 | " | " | 9 | " | " | " | " | " |
| 10 | 25 | " | 10 | " | " | " | " | " |
| 11 | " | 70 | 11 | 100 | 30 | 25 | 43 | 60 |
| 12 | " | " | 12 | " | " | " | " | " |
| 13 | " | " | 13 | " | " | " | " | " |
| 14 | " | " | 14 | 80 | " | " | " | " |
| 15 | 20 | 80 | 15 | " | " | " | " | " |
| 16 | " | " | 16 | 100 | 27 | " | 45 | " |
| 17 | " | " | 17 | 200 | 80 | " | 50 | 80 |

TABLE 1(b)

| Prior process | | | Present invention | | | | | |
|---|---|---|---|---|---|---|---|---|
| | | | | Primary rolling | | Secondary rolling | | Total |
| Sample No. | Rolling temperature (°C.) | Reduction rate (%) | Sample No. | Temperature (°C.) | Reduction rate (%) | Temperature (°C.) | Reduction rate (%) | reduction rate (%) |
| 18 | 20 | 80 | 18 | 100 | 40 | 25 | 50 | 70 |
| 19 | " | " | 19 | " | " | " | " | " |
| 20 | " | " | 20 | " | " | " | " | " |
| 21 | 30 | 85 | 21 | 400 | " | " | " | 80 |
| 22 | " | " | 22 | 80 | " | " | " | " |
| 23 | " | " | 23 | 300 | " | " | " | " |
| 24 | " | " | 24 | 500 | " | " | " | " |
| 25 | 25 | 90 | 25 | " | " | " | " | " |
| 26 | " | " | 26 | " | " | " | " | " |
| 27 | " | " | 27 | 150 | 61 | 25 | 50 | " |
| 28 | 20 | " | 28 | 100 | " | 20 | " | " |
| 29 | " | " | 29 | 42 | " | 25 | " | " |
| | | | 30 | 100 | " | 25 | " | " |
| | | | 31 | " | 63 | 25 | 70 | 90 |
| | | | 32 | 80 | " | 20 | " | " |

TABLE 1(b)-continued

| Prior process | | | Present invention | | | | | |
|---|---|---|---|---|---|---|---|---|
| | Rolling | | | Primary rolling | | Secondary rolling | | Total |
| Sample No. | temperature (°C.) | Reduction rate (%) | Sample No. | Temperature (°C.) | Reduction rate (%) | Temperature (°C.) | Reduction rate (%) | reduction rate (%) |
| | | | 33 | " | " | " | " | " |

According to FIG. 2, the fatigue strength of the steels of the present invention is far higher than that of the prior process in the same hardness, so that the zones confined by plotting are distinctly distinguished in both the processes.

According to the present invention, even in the high hardness region of Hv > 540, the lowering of the fatigue strength is not substantially recognized and this property has never been foreseen in the prior process nor realized.

Figure 3A:
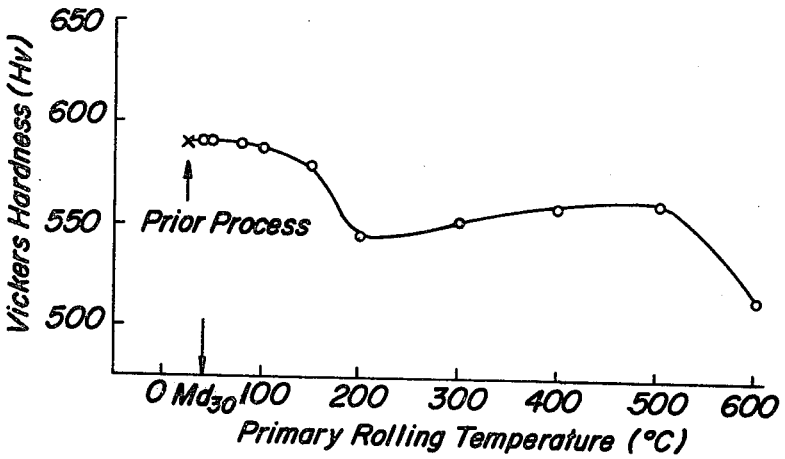
Figure 3B:
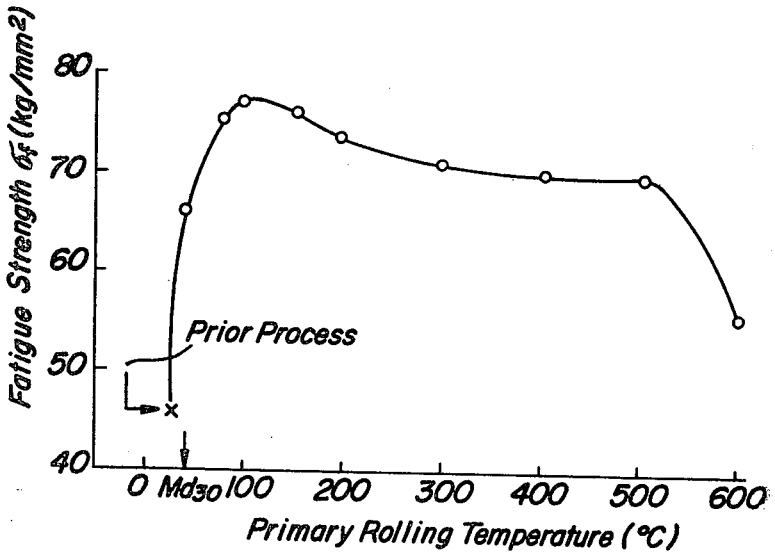

FIGS. 3(*a*) and (*b*) show the variations of the hardness and the fatigue strength when the same SUS 301 as in FIG. 2 was used as the material and said material was treated by varying the temperature ($T_1$) of the primary rolling and selecting the secondary rolling temperature at room temperature (25° C.) and then tempering said material at 400° C., where the primary rolling reduction rate was 61% and the secondary rolling reduction rate was 50% (total reduction rate: 80%). Mark X in the left end of the graphs is the result when the rolling temperature is always room temperature, that is the result of the prior process.

The hardness (Hv) indicates the highest value when $T_1$ is within the range from room temperature to 150° C. and when $T_1$ elevates, the hardness shows the somewhat lowering, and when $T_1$ exceeds 500° C., the hardness rapidly falls down.

On the other hand, the fatigue strength ($\sigma_f$) gener ally shows the far higher value than that of the conventional product rolled at room temperature and in the examples in this figure, when $T_1$ is near 100° C., the maximum value is observed but when $T_1$ exceeds 500° C., the fatigue strength rapidly lowers.

Figure 4:
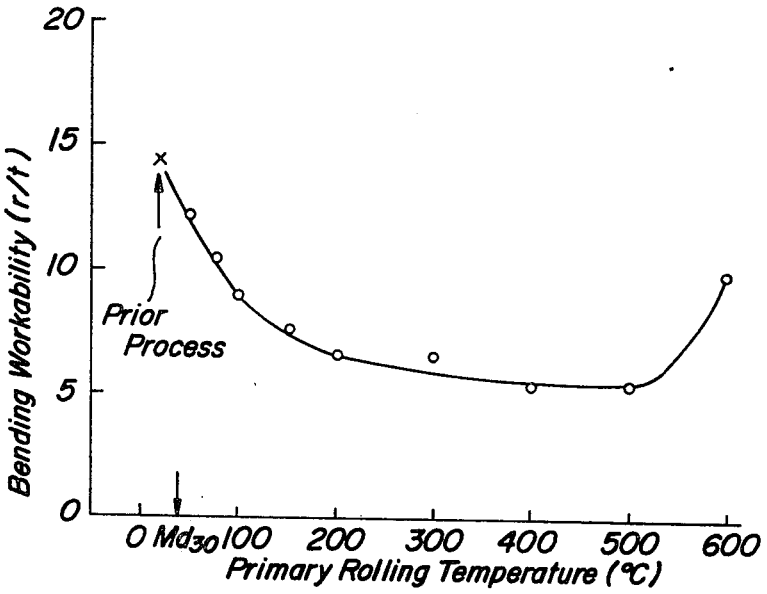

Furthermore, it is a very important property that the as-rolled bending workability is high and FIG. 4 shows the relation of the bending workability to $T_1$ with respect to the as-rolled material produced in the same process as in the example in FIG. 3. As $T_1$ increases, r/t (r: the minimum bending radius when the surface roughing does not appear, t: thickness of the sample sheet) decreases and the bending workability becomes good.

The technical significance of the present invention will be explained while mentioning the metallurgical difference of the functional effect between the present invention and the prior process hereinafter.

In ordinary SUS 301, SUS 304 or austenitic stainless steels similar to these stainless steels, Md point (the temperature of the upper limit at which martensite is induced by the plastic deformation after solution treatment) is near room temperature, so that if these steels are strongly worked at room temperature after the solution treatment of the conventional process, a major part of austenite is transformed into martensite and the high strength and the fatigue resistance as shown in FIG. 1 corresponding thereto are shown.

It has been well known that in general, the formation of martensite is greatly influenced by the chemical composition, the quantity of working and the working temperature but concerning the spring material, the improvement of the strength is not satisfactorily achieved only by increasing the formation of martensite by controlling these factors and particularly the improvement of the fatigue resistance is difficult.

It has not been yet known that what factor controls the fatigue strength of the highly worked materials and even if the structure of the highly worked material is observed microscopically, the detailed identification is difficult, but the martensite formed by the mere cold rolling is probably large in size and not uniformly dispersed which may have something to do with the fatigue property of the steel.

In this kind of material, a fairly large amount of martensite is formed from the original stage of deformation in the cold rolling after solution treatment of the hot rolled sheet but in this case, the strain substantially disappears in the austenite phase by the solution treatment, so that the site for forming the martensite nucleus is few and if martensite is once formed, it rapidly grows owing to very few obstruction, and the structure with the block martensite ununiformly dispersed is formed.

Based on such a presumption, the inventors have had the idea that the uniform fine martensite structure may be obtained by adopting two-stage working process after the above described solution treatment.

That is, the final cold working process is divided into two stages and in the primary stage the working temperature and the quantity of working are selected depending upon the composition of the steel so that no martensite is formed and only austenite is plastically deformed or even if a small amount of martensite is formed, the introduction of the dislocation and the lattice defect into the austenite phase is far larger than the formation of martensite, and then in the secondary stage, if the working temperature is lowered and the necessary rolling rate is given and the martensite is formed by making the dislocation and the lattice defect introduced into the austenite in the primary stage as the necleus, the sites for forming the martensite nucleus are so many and the growth is restrained by the lattice defect of the austenite phase, so that the structure with very fine martensite uniformly dispersed can be obtained.

Thus, the material having a high strength and a high resistance against the initiation and propagation of the fatigue crack has been obtained and this is the metallurgical foundation from which the process of the present invention has been derived and from such a forecast, the detailed experiment and analysis were carried out under the concrete condition as mentioned above resulting into the complete accomplishment of the initial target.

The present invention utilizes the phenomenon of strain induced martensite transformation and in this connection, all the above described austenitic stainless steels causing this phenomenon become the subject of the present invention. Accordingly, the steel to form the strain induced martensite among the precipitation hardening stainless steels represented by 17-7 PH steel (SUS 631), is naturally applicable to the present invention and is included in "austenitic stainless steels" in the present invention.

From this view point, the component composition of the present invention is limited from the following reason.

C: not more than 0.15%, the larger carbon content forms the harder martensite, so that the larger content is desirable. But when the content is too large, the transforming ability into martensite becomes poor and the austenite is too stabilized, so that the formation of martensite becomes difficult. Accordingly, the upper limit is 0.15%.

Si: 0.3–2.0%. The minimum amount of 0.3% of silicon is necessary as the deoxidizing agent. For the development of hardness due to the tempering treatment, the larger content is desirable but according to the present invention, the high hardness can be obtained without broadly lowering the fatigue resistance and without the aid of silicon, so that the upper limit is 2.0% in view of restraining the formation of δ ferrite in the minimum amount.

Mn: 0.5–2.0%. Manganese needs 0.5% in the minimum amount as the deoxidizing agent. In order to harden the material by the rolling, the larger content is better, but if the content is too large, the formation of martensite is retarded and the fatigue resistance is deteriorated, so that the upper limit is defined to be 2.0%.

Ni: 6.0–14.0%. Nickel is an essential component of austenite stainless steel and in order to prevent the precipitation of δ ferrite or the complete transformation into martensite in the solution treating state, an amount of not less than 6.0% is necessary, but if the amount is too large, the formation of martensite owing to the working is not only retarded, but also the production cost becomes too high, so that the limitation is 6.0–14.0%.

Cr: 13.0–20.0%. Chromium is an element characterizing the alloy to stainless steel and in order to ensure the corrosion resistance, 13.0% is necessary in the minimum amount. However, when the addition is too excessive, δ ferrite precipitates in the austenite matrix and the hot workability is degraded, so that the amount is 13.0–20.0%.

The above described elements are the fundamental components and if necessary, at least one of the following three elements is added. The reason of limitation of these elements is as follows.

Al: not more than 1.5%. Aluminum is the element characterizing to the precipitation hardening austenitic stainless steels and the more it is added, the more noticeable precipitation hardening is. But when the amount exceeds 1.5%, problem is caused in the surface defect and the workability, so that the amount is not more than 1.5%. When aluminum is not added, usual metastable austenitic stainless steels are formed.

Mo: not more than 2.0%. In order to more improve the corrosion resistance, if necessary, molybdenum is added. The content is 2.0% in the maximum amount and the addition of more than said amount brings about the cost up. Therefore, the amount is not more than 2.0%.

Cu: not more than 3.0%. Copper may be added in order to intend the improvement of the workability in the rolling process and the promotion of the age hardening owing to the tempering at a low temperature. The maximum content is 3.0%. As the addition of more than said amount brings about the deterioration of the hot workability, the amount is not more than 3.0%.

$Md_{30}$:0° C. to +80° C. The desirable composition range of each component is as mentioned above, but it can not be said that if the respective component is within this range, any combination of the components is admissable. Instead, the components should be balanced so that $Md_{30}$ is 0° C. To +80° C. Because if $Md_{30}$ is lower than 0° C., the austenite is too much stabilized and the formation of martensite due to the working becomes difficult, while if $Md_{30}$ is higher than +80° C., the austenite becomes too much unstable and the martensite is excessively formed at the original stage of the working, and in both cases, the improvement of the fatigue resistance is retarded.

The reason why the temperature of the heat treatment prior to the two-stage cold rolling is defined to be 750°–1,150° C. is as follows. It is necessary to soften the material by reversely transforming the martensite prior to the working, but at a temperature of lower than 750° C., chromium carbide precipitates and the corrosion resistance lowers, while the temperature exceeds 1,150° C., there is fear that δ ferrite is formed.

The reason why the lower limit of the primary working temperature is $Md_{30}$, is as follows.

An amount of the strain induced martensite formed is strongly influenced by the austenite stability and the working temperature of the steel and as shown in FIG. 3, when the working temperature is lower than $Md_{30}$ (this is an indication showing the austenite stability by temperature, which is determined by the chemical composition and the grain size as mentioned before; in SUS 301 steel used in FIG. 3, $Md_{30}$=42° C.), the fatigue strength of the final product rapidly decreases.

Figure 5:
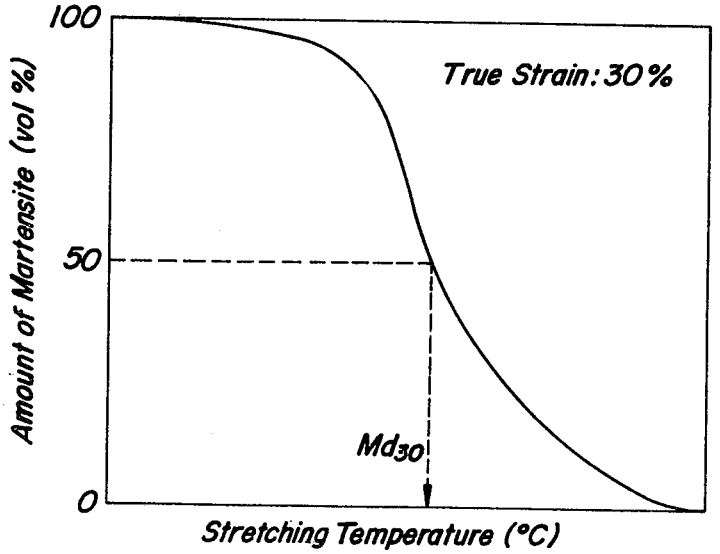

In general, the relation between the working temperature and the amount of martensite formed in austenitic stainless steel shows an inflexion point near $Md_{30}$ as shown in FIG. 5. When the working temperature is lower than $Md_{30}$, the amount of martensite formed owing to the induced-strain of 30% rapidly increases to more than 50%. This means that the volume fraction of austenite in the structure decreases and the uniform formation of the fine martensite in the secondary step due to the introduction of the lattice defect into austenite as mentioned above can not be expected.

From such a view point and the experimental result, the lower limit of the temperature in the primary working step has been defined to be the $Md_{30}$ temperature.

The experimental formula for determining $Md_{30}$ has been reported by T. Angel: JISI, 177(1954), 165; I. J. Sjoberg: Wire, (1973), 155 or T. Gladman et. al.: Sheet Met. Ind., May (1974), 219 other than the above described equation. Any of these results are substantially similar. Even if $Md_{30}$ is defined by using either one of them and is applied to the technique of the present invention or the indication of the austenite stability (for example, Ni equivalent—S. Floreen et. al.: ASTM Spec. Tech. Publ., No. 369(1965), 17; Ms temperature—G. H. Eichelman et al.: Trans. ASM, 45(1953), 77) other than $Md_{30}$ is applied and the lower limit of the primary working temperature is determined thereby, the technical idea of the present invention is not essentially affected.

In short, it is the fundamental technique of the present invention that the sufficient strain is given to the austenite phase without inducing a large amount of martensite in the original working step.

The reason why the upper limit of the temperature of the primary working step is defined to be 500° C., is as follows. As shown in FIG. 3 and FIG. 4, at the temperature above the upper limit, not only the hardness, the fatigue strength and the bending workability are deteriorated, but also the grain boundary corrosion acutely occurs, that is, the precipitation of chromium carbide into austenite grain boundary occurs and the corrosion resistance is deteriorated. Moreover the deposition of oxide scale on the steel surface is caused.

The reason why the primary reduction rate is defined to be not less than 20% is based on the fact that when this value is less than 20%, the accumulation of the deformed strain to the austenite phase is not sufficient, so that the effect for improvement of the fatigue resistance due to the uniform formation of fine martensite upon the secondary rolling stage can not be expected.

The reason why the secondary working temperature is defined to be lower than $Md_{30}$ is as follows. The secondary rolling stage is intended to induce a necessary and sufficient amount of martensite and therefore, as seen from FIG. 5, the lower rolling temperature is required. The upper temperature limit varies depending upon the austenite stability of the steel but as the result of the experiment and study, it has been concluded that in order to accomplish the aim of the present invention, the upper limit is defined to be $Md_{30}$. In this case, when the secondary rolling reduction rate is less than 30%, even if the working temperature is lower than $Md_{30}$, the formation of martensite and the hardening of the austenite phase are insufficient, so that the reduction rate is not less than 30%.

Furthermore, in some case, the tempering treatment at a temperature from 200° C. to As point is carried out after the secondary working. The object lies in stabilization of the formed martensite structure by the working and adjustment of the hardness of the final product.

In this case, the strain edge hardening does not satisfactorily occur at a temperature lower than 200° C., and if the temperature is higher than As point (that of SUS 301 used in FIG. 2 is 550° C.), the formed martensite is reversely transformed into austenite and the steel is softened, so that the tempering temperature is defined to be within the above described range.

Furthermore, in the primary working, if the temperature is from $Md_{30}$ to 500° C., it is not necessary to particularly define the pass number of rolling and the rolling temperature in each pass and it is merely necessary that the reduction rate until the working which is started at said temperature range, is finished, is not less than 20%, and then there is no problem in the history of the pass number and the temperature in the rolling. That is, it is important that the temperature of the material in the primary working, particularly just before the first pass, is $Md_{30}$-500° C. and the successive temperature change in the primary working does not become particularly problem. In general, the steel raises temperature owing to working but even if the temperature after the pass is elevated higher than the temperature at the preceding rolling, as far as said temperature does not exceed 500° C., there is no problem. Alternatively, even if the temperature is raised or lowered artificially between $Md_{30}$ and 500° C., there is no problem. Furthermore, if the temperature starting the primary working is not lower than $Md_{30}$, even if the temperature after the pass becomes lower than $Md_{30}$ owing to any reason (for example cooling oil), said pass may be included in the primary working step based on the present invention.

The present invention is characterized in the two-stage working in which the temperature is classified. In this point, the impression that the working is complicated and the operation efficiency is low, might be given, but when the thin flat spring material is produced by the conventional one-stage process, in order to obtain the desired hardness without causing the excessive hardening, an amount of martensite formed must be properly controlled, so that it is necessary to strictly control the temperature of the material during rolling at near room temperature and therefore the rolling speed must be lowered. While in the primary working in the present invention, it is not necessary to strictly control the raising of the temperature of the material and further since martensite is not formed in a large amount, the steel is not too hardened and therefore the rolling is very easy.

In addition, by selecting the rolling schedule properly (namely, by choosing the rolling temperature to be $Md_{30}$), it is possible to connect the final pass in the primary working with the original pass in the secondary rolling, and in short, there is no fear that the productivity of the present invention is inferior to that of the prior process.

The heating or insurance of temperature prior to the primary working may be apparently conducted by any means.

For better understanding of the invention, reference is taken to the accompanying drawings, wherein, FIG. 1 is a view showing relation of Vickers hardness to the fatigue resistance of SUS 301 thin flat spring material produced by the conventional process;

FIG. 2 is a view showing relation of Vickers hardness to the fatigue resistance of SUS 301 thin flat spring material produced by the present invention showing together the relation shown in FIG. 1;

FIG. 3, (*a*) is a view showing relation of Vickers hardness to the primary rolling temperature of SUS 301 thin flat spring material produced by the present invention, and (*b*) is a view showing relation of the fatigue strength to the primary rolling temperature of the above described spring material;

FIG. 4 is a view showing relation of the bending workability of the primary rolling temperature of SUS 301 thin flat spring material produced by the present invention; and FIG. 5 is a view showing relation of the amount of martensite formed to the working temperature when 30% of true strain is applied to SUS 301 at various temperatures.

Examples of the present invention will be explained by comparing with the prior materials.

The following Table 2 shows the working conditions when SUS 301 steel of $Md_{30}$ being 42° C. is worked with the process of the present invention (Nos. 1-5), worked with the comparative process (Nos. 7 and 8), and worked with the prior process (Nos. 9-11). And when SUS 301 steel of $Md_{30}$ being 0° C. is worked with the process of the present invention (No. 6), Vickers hardness and the fatigue strength measured by the above mentioned alternating plane bending fatigue testing machine concerning the as-rolled samples and the samples after having tempered at 400° C. for 1 hour are also given.

TABLE 2

| | Sample No. | $Md_{30}$ °C. | Primary rolling Temperature (°C.) | Primary rolling Reduction rate (%) | Secondary rolling Temperature (°C.) | Secondary rolling Reduction rate (%) | Total reduction rate (%) | as-rolled Vickers hardness | as-rolled Fatigue strength (kg/mm²) | Tempering treatment 400° C. × 1 h Vickers hardness | Tempering treatment 400° C. × 1 h Fatigue strength (kg/mm²) |
|---|---|---|---|---|---|---|---|---|---|---|---|
| Present invention | 1 | 42 | 80 | 61 | 25 | 50 | 80 | 557 | 73 | 561 | 74 |
| | 2 | " | 100 | " | " | " | " | 571 | 76 | 582 | 77 |
| | 3 | " | " | 27 | " | 45 | 60 | 525 | 70 | 530 | 70 |
| | 4 | " | " | 63 | " | 70 | 90 | 598 | 67 | 605 | 70 |
| | 5 | " | 300 | 61 | " | 50 | 80 | 555 | 73 | 560 | 72 |
| | 6 | 0 | 80 | " | −10 | " | " | 575 | 71 | 590 | 73 |
| Comparative process | 7 | 42 | 100 | 17 | 25 | 52 | 60 | 503 | 53 | 515 | 55 |
| | 8 | " | 80 | 61 | 55 | 50 | 80 | 510 | 51 | 519 | 56 |
| Prior process | 9 | " | | | 25° C. | | 60 | 518 | 47 | 536 | 49 |
| | 10 | " | | | " | | 80 | 559 | 46 | 586 | 46 |
| | 11 | " | | | " | | 90 | 581 | 40 | 603 | 40 |

Note: Sheet thickness: 0.45 mm

The sample sheets were produced as follows. The steel ingot produced by the usual electric furnace process was bloomed by heating at 1,200° C. to obtain a slab and then the slab was hot rolled into a sheet having a thickness of 4.0 mm.

Among the samples, No. 4 and No. 11 were heat treated as such at 1,100° C. Nos. 1, 2, 5, 6, 8 and 10 were cold rolled to a thickness of 2.3 mm and then heat treated at 1,000° C. Nos. 3, 7 and 9 were cold rolled to a thickness of 1.1 mm and then heat treated at 900° C.

Such a preparation was carried out for the following reason. Thus, it was necessary to vary the thickness of the mother sheet in order to vary the reduction rate in the rolling process and to make the final thickness to be constant (0.45 mm).

The sheets having a thickness of 0.45 mm were prepared by the two-stage rolling as shown in Table 2 in Nos. 1–6 within the definition of the present invention and Nos. 7 and 8 wherein the primary rolling reduction rate or the secondary rolling temperature are beyond the definition of the present invention, or by one-stage rolling in Nos. 9–11.

In the primary rolling in Nos. 1, 4 and 6, each pass was conducted at the particularly defined temperature shown in Table 2. In Nos. 2, 3, 5, 7, and 8, the first pass was conducted at the temperature shown in Table 2 and then the passes were conducted while gradually lowering the temperature within the range to $Md_{30}$.

The hardness of the prior process (Nos. 9–11) shows Hv of 518-581 in the as-rolled specimens and Hv of 536–603 after tempering, but all the fatigue strength is less than 50 kg/mm² and similar to Nos. 7 and 8 conforming to the comparative process. On the contrary, in the present invention (Nos. 1, 2, 4, 5 and 6), all Hv before and after the tempering treatment is more than 550 and all the fatigue strength is more than 70 kg/mm² and the value about 50% larger than that in the prior process is obtained. In particular, in No. 4 after tempering treatment, Hv is more than 600 and $\sigma_f$ is 70 kg/mm². This shows the high strength and fatigue resistance which have never been considered heretofore.

As mentioned above, the stainless steel spring materials obtained by the present invention have much higher fatigue resistance than those of the prior process and in particular, even though the hardness is higher, the fatigue resistance is excellent and the bending workability and the threshold value of spring are high and the corrosion resistance is also excellent and further the commercial production cost is not high, so that the steels are advantageously applied to retractor spiral spring of automobile and all other spring uses.

The above described various data are the result concerning the rolling working and also in the case of wire working and extrusion working, the above described theory can be completely applied to the micro-structure of the material, so that this invention can be applied to any of rolling, drawing and extruding.

What is claimed is:

1. A process for producing stainless steels for springs having a high strength in the range of about 550–600 Vickers Hardness, and an excellent fatigue resistance of at least 70 kg/mm², which comprises heat treating austenitic stainless steels having such a composition that austenite stability index $Md_{30}$ is 0° C. to +80° C. at a temperature from 750° C. to 1,150° C., subjecting the thus treated steels to a primary working at a temperature from $Md_{30}$ to 500° C. at a reduction rate of not less than 20%, and then subjecting said steels to a secondary working at a temperature from −10° C. to $Md_{30}$ at a reduction rate of not less than 30%, and after the secondary working, tempering the obtained steel sheet at a temperature from 200° C. to not higher than the austenite forming temperature.

2. The process as claimed in claim 1, wherein $$Md_{30}=551-462(C\%+N\%)-9.2Si\%-8.1Mn\%-29(Ni\%+Cu\%)-13.7Cr\%-18Mo\%+0\times Al\%-68(Nb\%+Ti\%+Ta\%)-1.4(\text{ASTM austenite grain size number}-8.0)$$ (%: weight %).

* * * * *